United States Patent [19]

Gref et al.

[11] 4,221,184

[45] Sep. 9, 1980

[54] CASTING BLOCK OF STABLE SHAPE

[75] Inventors: Hans Gref, Cologne; Karl Voss; Willi Wasser, both of Leverkusen, all of Fed. Rep. of Germany

[73] Assignee: Agfa-Gevaert Aktiengesellschaft, Leverkusen, Fed. Rep. of Germany

[21] Appl. No.: 903,768

[22] Filed: May 8, 1978

[30] Foreign Application Priority Data

May 11, 1977 [DE] Fed. Rep. of Germany ..... 2721184

[51] Int. Cl.[3] ..... B05C 5/02

[52] U.S. Cl. ..... 118/412; 29/405; 29/445

[58] Field of Search ..... 29/405, 445; 118/412, 118/410, 411, 407, 258; 101/364

[56] References Cited

U.S. PATENT DOCUMENTS

| | | | |
|---|---|---|---|
| 3,220,877 | 11/1965 | Johnson | 118/412 X |
| 3,289,632 | 12/1966 | Barstow | 118/412 |
| 3,418,970 | 12/1968 | Phelps et al. | 118/410 |

*Primary Examiner*—John P. McIntosh

*Attorney, Agent, or Firm*—Connolly and Hutz

[57] ABSTRACT

The invention relates to a commonly used type of casting device for coating webs with a single or a plurality of layers, comprising a casting block supported by brackets and comprising a plurality of shaped parts screwed together, in the casting block being rigidly fixed to a torsion-free hollow support and forming therewith a unit which is fixed to the brackets by a three-point bearing.

7 Claims, 9 Drawing Figures

CASTING BLOCK OF STABLE SHAPE

Figure 1A:
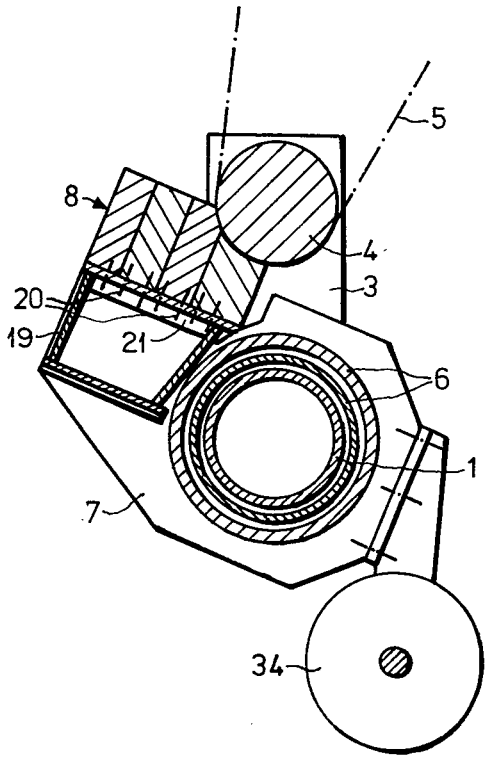

The invention relates to a commonly used type of casting device for coating webs in particular photographic films and papers, with a single layer or a plurality of layers, in which a casting block supported by brackets is composed of a plurality of shaped parts screwed together. Such casting blocks are known from German Patent Application Nos. 1,211,488; 2,238,133 and others.

Very high precision is demanded of these casting blocks. In order to obtain a coating which is free of defects, it is particularly important for the sloping casting surface to be perfectly smooth and the overflow edges of the extrusion slits to be perfectly horizontal. Deformations of as little as a few microns can cause stripes in the coating.

The block consisting of shaped parts is produced by firstly machining the parts using cutting tools and then screwing them together. The block thus assembled is then finely machined and screwed to the support brackets, and the sloping casting surface and the overflow edges are subjected to final machining in situ. Once the block, which is provided with holes for controlling the temperature, has been screwed together, it is connected to a system for controlling the temperature and adjusted to the operating temperature. The temperature is continuously controlled throughout further finishing and assembly.

The previously known design and methods of production has a number of disadvantages. There was always the disadvantage of the individual shaped parts becoming offset with respect to each other after screwing the block to the brackets. Edges which had previously been carefully machined parallel were suddenly offset by several microns. Possible causes of this are listed below:

1. The casting block has to be lifted and carried repeatedly during machining. It is uncontrollably subjected to torsion during this process. This means that considerable shearing forces which lead to the above mentioned displacement are often transferred to the joints between the profiled parts.
2. When the casting block is screwed to the brackets, each screw exerts a force on the individual shaped part and this is transmitted in part as a shearing force via the joints into the adjacent shaped parts thus possibly causing displacement.
3. Furthermore, particular care has to be taken when mounting the block on the brackets. The bearing surfaces of the block are cleanly machined parallel to each other. The opposing surfaces of the brackets also have to be cleanly machined parallel to each other, otherwise a torsional moment is produced by the weight of the block. This requirement is difficult to satisfy owing to the close tolerances which have to be observed. Even small errors in the parallelism of the bearing surfaces lead to torsion and thus to displacements which cannot be tolerated.

Suitable precision should be regulated on the take-up means during machining.

However, the undesirable displacements do not only take place during finishing and assembly. Manufacture of coated strips often takes place on a casting machine having different casting widths. The casting block has to be exchanged to change the casting width. This change-over operation in conjunction with the associated transportation required involves the same dangers with regard to the deformation of the casting block as its initial assembly. The fact that displacements which are produced at this stage usually result in a longer interruption in operation, makes the procedure more complicated.

The object of the invention is to provide a casting device which does not have these disadvantages. Thus, it should be possible to assemble and effect simple exchange of the block without producing deformations on the overflow edges and on the sloping casting surface.

According to the invention there is provided a casting device for coating a strip with a single layer or a plurality of layers, comprising a casting block supported by brackets and comprising a plurality of shaped parts screwed together, in the casting block being rigidly fixed to a torsion-free hollow support and forming therewith a unit which is fixed to the brackets The hollow support preferably has two tubular passages with three annular necks for loading it on to a transporting means.

The transporting means may be provided with a transporting fork having parallel prongs. In this process for producing and assembling the unit, the casting block is rigidly connected to the hollow support before final machining and the unit is brought to the operating temperature.

The unit is preferably supported on auxiliary brackets by means of the three-point bearing during machining on the machine tool or the work bench and is laid on three annular necks during transportation and mounted on the brackets during and after assembly by means of the three-point bearing.

Figure 1B:
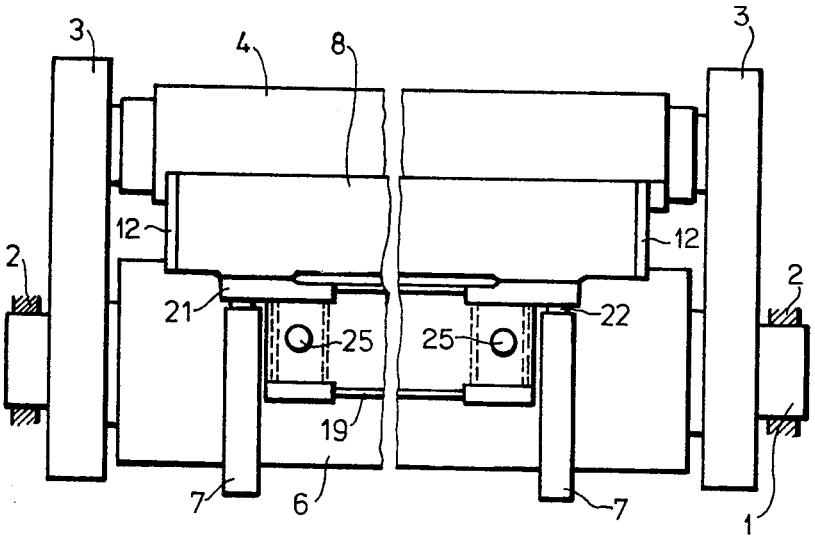
Figure 1C:
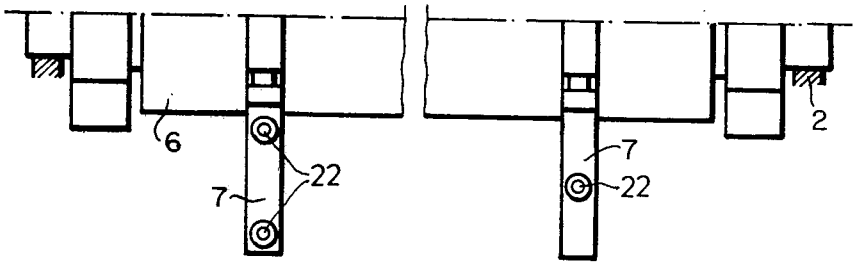

For reasons of clarity, the invention is described below by way of example with a description of a casting device having the same basic structure as the one in German Patent Application No. 1,652,271. The description is illustrated in the accompanying drawings in which:

FIGS. 1*a* to 1*c* show the casting means pivotal away from the casting roller in the operating position, more specifically;

FIG. 1*a* shows a cross sectional view of the mounted casting of this invention;

FIG. 1*b* shows a left side elevational view of FIG. 1*a;*

Figure 2A:
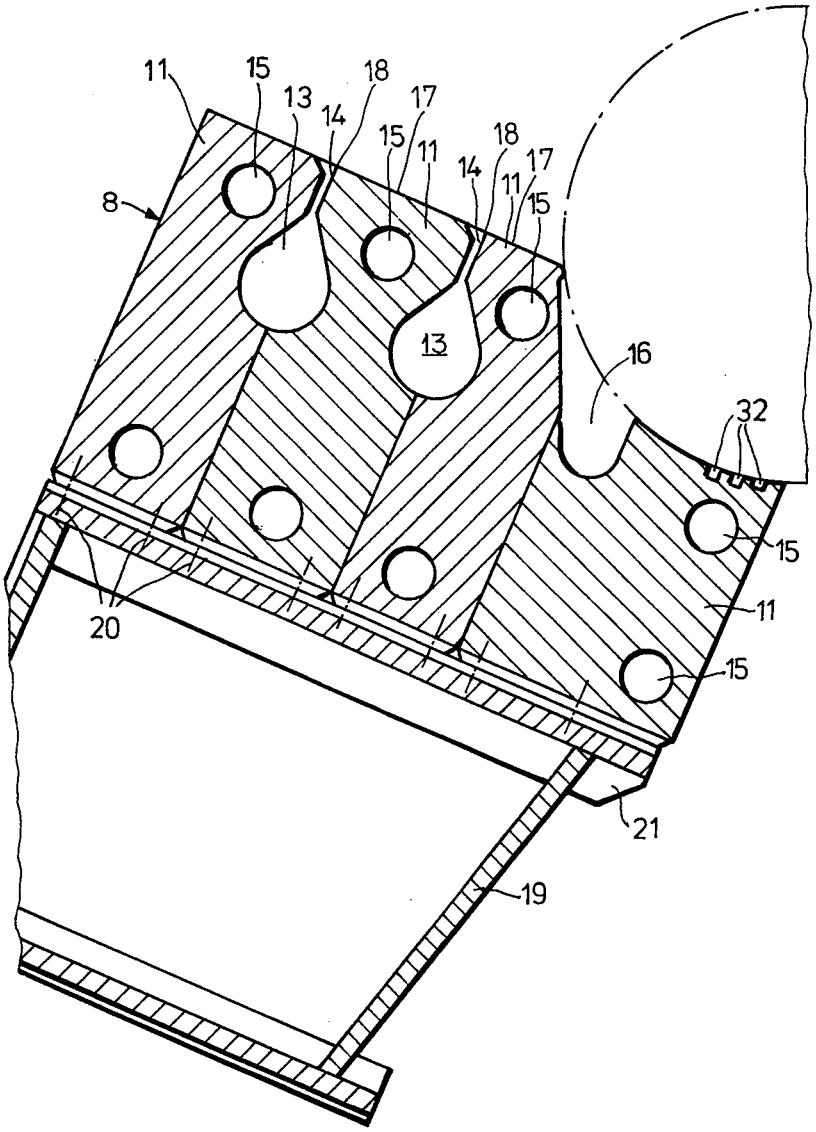
Figure 2B:
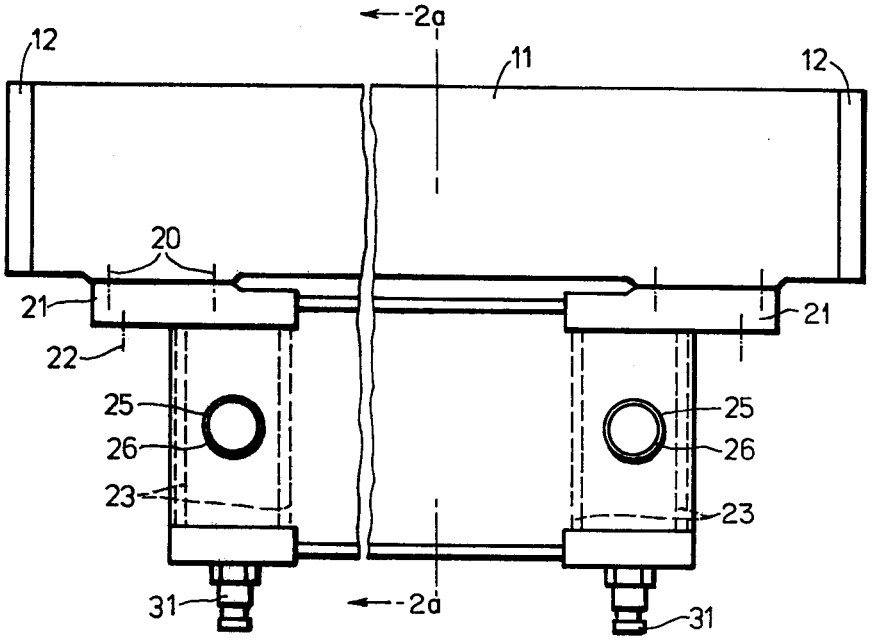
Figure 3B:
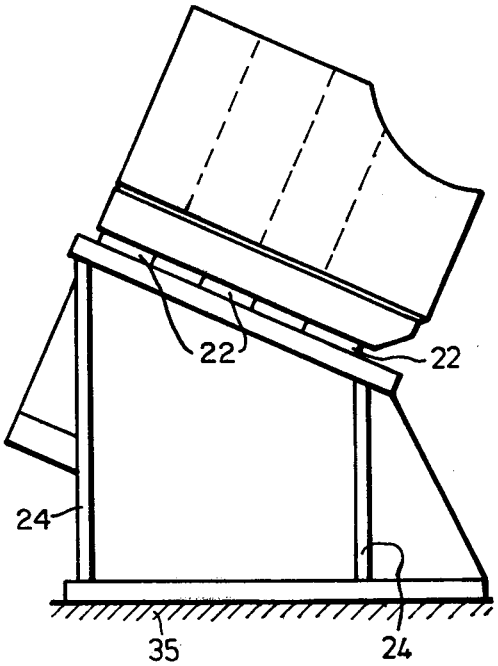
Figure 3A:
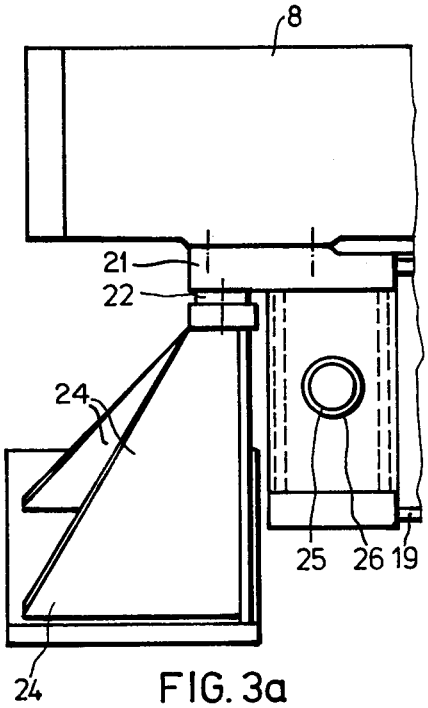

FIG. 1*c* shows a partial plan view of the supporting structure of the caster;

FIG. 2*a* shows a cross sectional view taken along line 2*a*—2*a* of FIG. 2*b* of the casting block and hollow support;

FIG. 2*b* shows a left side elevational view of the block and hollow support;

FIG. 3*a* is a fragmental front elevational view showing the way in which the casting block screwed to a hollow support to form a unit that is mounted on an auxiliary bracket during machining;

FIG. 3*b* shows side elevational view of the casting blocks shown in FIG. 3*a;*

Figure 3C:
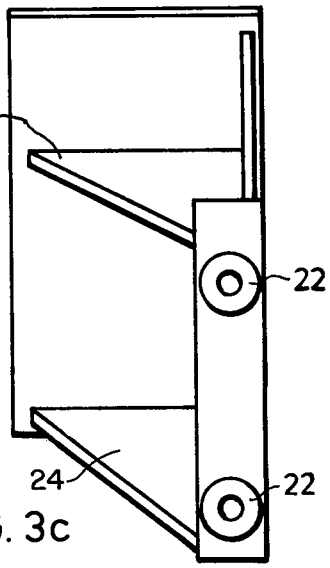
Figure 4:
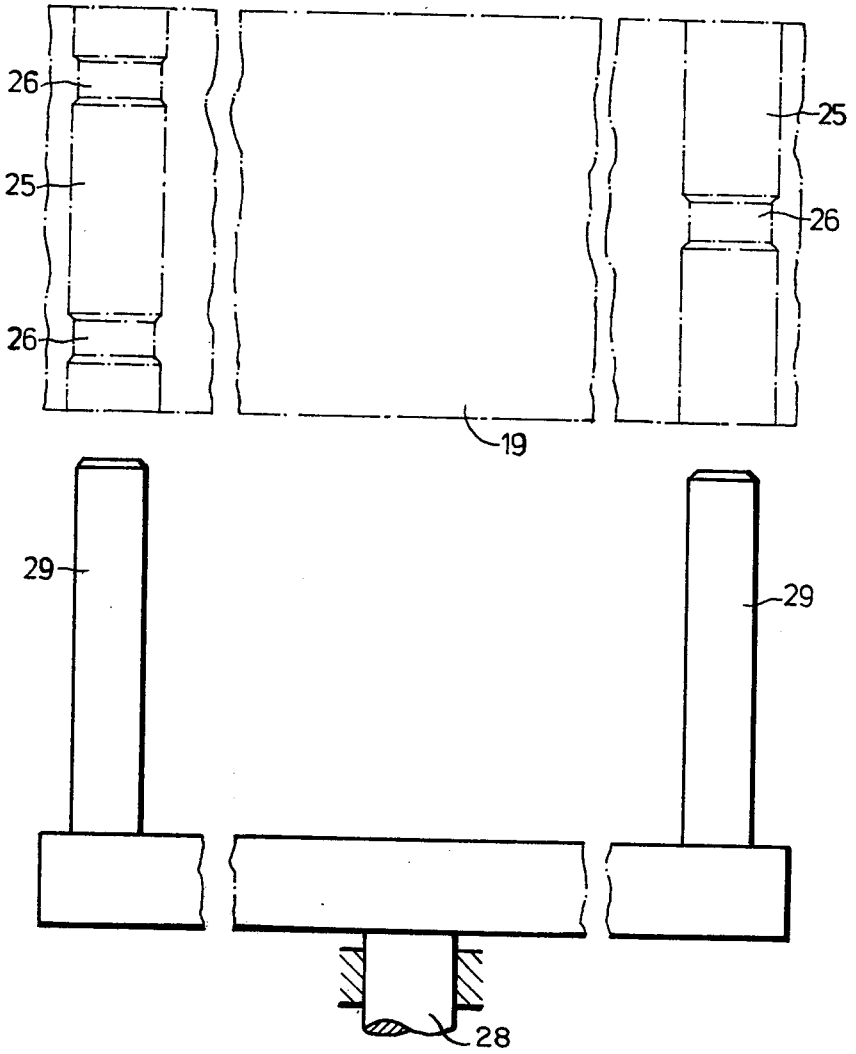

FIG. 3*c* shows a top plan view of the bracket shown in FIGS. 3*a* and 3*b;* and FIG. 4 shows a transporting fork as auxiliary means for transporting the unit composed of the block and hollow support.

As shown in FIGS. 1*a* to 1*c*, the casting means is mounted on the central tube 1 which, in turn, is fixed on the frame (shown in FIGS. 3*a* to 3*c*) of the casting machine by means of a clamp 2. Two spacer blocks 3 clamped on the central tube 1 support a casting roller 4 via which a web 5 to be coated is guided. A double-walled tube 6, the temperature of which may be adjusted, is arranged pivotally on the central tube 1 and two brackets 7 for holding the casting block 8 and a counter-weight 34 are fixed on the double-walled tube 6.

The casting block 8 is rigidly connected to a hollow support 19 by screws 20 and forms a unit 8/19 therewith. FIGS. 2*a* and 2*b* show the casting block 8 which consists of shaped parts 11 and two end parts 12, and which is designated as a two-layer casting device in this case, and a separate hollow support 19. Chambers for distributing emulsion are designated by the numeral 13, extrusion slits by the numeral 14, overflow edges by the numeral 18, a sloping pouring surface by the numeral 17, temperature control holes by the numeral 15, a reduced pressure chamber by the numeral 16 and associated labyrinths by the numeral 32.

The mode of operation of the casting device may be assumed known.

The length of the hollow support 19 corresponds to the distance between the two brackets 7. The unit 8/19 is fixed on the brackets 7 only, by means of a three-point bearing 22 on flanges 21 of the hollow support 19. A strong flange 21 in conjunction with the ribs 23 ensures that a force is properly transmitted to the hollow support 19.

The hollow space in the support 19 is communicated with a temperature control system by means of the connectors 31.

The unit 8/19 is produced and assembled by the following operations:

1. Producing the shaped parts 11 and the end parts 12 on cutting machine tools;

2. Screwing the parts together to form the casting block 8 (FIG. 1*a*):

3. Screwing the block 8 to the separately produced hollow support 19 using screws 20 to form the unit 8/19:

4. Adjusting the temperature of the unit 8/19 to operating temperature: The temperature control is maintained uninterrupted throughout subsequent finishing and assembly.

5. Machining the unit 8/19 on the grinding machine:

6. If necessary, finely machining the casting surface 17 and the edges 18 (FIG. 2*a*) by shaving and lapping:

7. Placing the unit 8/19 on the brackets 7 and fixing it using the screws of the three-point bearing 22 (FIGS. 1*b* and 1*c*):

8. Final in situ machining of the sloping casting surface 17 and the overflow edges 18.

When the unit 8/19 is being machined on the tool machine or work bench 35 in operations 5 and 6, the three-point bearing 22 simultaneously acts as a support with the aid of the auxiliary brackets 24 shown in FIGS. 3*a* to 3*c*. The inclination of the bearing surface of the brackets 24 corresponds to the operating position of the casting device. Errors caused by deformation of the casting device as a result of the forces of gravity acting in a different direction from machined surfaces are thus prevented during machining and during operation. The hollow support 19 has two tubular openings 25 in the vicinity of the flanges 21 with a total of three annular necks 26 corresponding to the bearing points of the three-point bearing 22 for holding a transporting fork.

The transporting fork is shown in FIG. 4 and comprises a shaft 28 fixed on a transporting means, for example a lifting truck (not shown). Prongs 29 are inserted in the x-direction into the openings 25 of the hollow support 19, as shown in phantom outline. The parallelism of the prongs 29 ensures that the unit 8/19 still only rests on three points during transportation. After screwing the shaped parts 11 and the end parts 12 to form the casting block 8, the latter is joined to the hollow support 19 in operation 3 using the screws 20 to form the unit 8/19. This unit is held on the brackets 7 throughout all subsequent finishing stages including assembly. When changing the coating width, the whole unit 8/19 is exchanged rather than just the block 8. After the finishing treatment, forces are therefore no longer exerted on the shaped parts by activating the fixing screws 20. This prevents the shaped parts from being displaced.

The casting block 8 is thus doubly protected from undesirable torsional stresses:

1. The unit 8/19 always rests on a three-point bearing via which a torsional moment can never be introduced from the outside.

2. If a torsional moment happens to be introduced in another manner, for example by inexpert transportation without using the transporting fork, the torsion is substantially taken up by the hollow support 19.

The casting block 8 is therefore exposed to practically no stress upon twisting.

What we claim is:

1. A casting device for coating a strip with a single layer or a plurality of layers, comprising a casting block supported by brackets during operation and otherwise on auxiliary brackets and comprising a plurality of shaped parts screwed together, a torsion-free hollow support, the casting block being rigidly fixed to the torsion-free hollow support and forming therewith a unit, a three-point bearing on the unit for maintaining it torsion-free on the brackets during operation and otherwise on the auxiliary brackets, and temperature control means in the casting device for maintaining its temperature substantially uniform when the device is being operated on the brackets and during final machining on the auxiliary brackets whereby the devices is maintained substantially free of torsion.

2. A device according to claim 1, wherein the hollow support has two tubular openings with three-annular necks substantially corresponding to three-point bearings for loading on a transporting means.

3. A device according to claim 2, wherein the transporting means is provided with a transporting fork with parallel prongs for insertion into the tubular openings.

4. A device according to claim 1, wherein the hollow support is mounted on a pivotal hollow tubular support by means of the brackets.

5. A device according to claim 4, wherein the pivotal hollow tubular support comprises a double-walled tube mounted about a central tube.

6. A device according to claim 5, wherein a temperature control system is connected to the double-walled tube.

7. A device according to claim 1, wherein couplings are connected to the hollow support in a position clear of interference with the brackets and auxiliary brackets whereby temperature controlled fluid can be supplied to the hollow support while the casting block is supported on the brackets and the auxiliary brackets.

* * * * *